United States Patent [19]

Boll et al.

[11] Patent Number: 4,905,832

[45] Date of Patent: Mar. 6, 1990

[54] PACKAGING FOR THE DISPLAY AND HANDLING OF SMALL OBJECTS

[75] Inventors: Werner Boll; Reiner Preuss; Peter Knoche, all of Solingen, Fed. Rep. of Germany

[73] Assignee: Müller & Schmidt Pfeilringwerk GmbH & Co., KG, Solingen, Fed. Rep. of Germany

[21] Appl. No.: 274,324

[22] Filed: Nov. 18, 1988

[30] Foreign Application Priority Data

Nov. 28, 1987 [DE] Fed. Rep. of Germany ..... 3740423

[51] Int. Cl.[4] ..... B65D 73/00

[52] U.S. Cl. ..... 206/470; 206/471; 206/806

[58] Field of Search ..... 206/461, 462, 464, 465, 206/470, 471, 45.31, 45.33, 45.34, 806

[56] References Cited

U.S. PATENT DOCUMENTS

| | | | |
|---|---|---|---|
| 2,633,238 | 3/1953 | Snyder | 206/45.33 |
| 3,104,011 | 9/1963 | Bowman | 206/45.33 |
| 3,198,681 | 8/1965 | Watts, Jr. | 206/470 X |
| 3,380,575 | 4/1968 | Hennessey | 206/45.34 |
| 3,404,774 | 10/1968 | Levine . | |
| 3,480,138 | 11/1969 | Baker | 206/461 |
| 3,487,915 | 1/1970 | Scott | 206/461 X |
| 4,014,134 | 3/1977 | Womack, Jr. | 206/461 X |
| 4,496,052 | 1/1985 | Nertman | 206/470 |

FOREIGN PATENT DOCUMENTS

| | | |
|---|---|---|
| 3476117 | 2/1976 | Fed. Rep. of Germany . |
| 7729867 | 4/1978 | Fed. Rep. of Germany . |
| 7920462 | 10/1979 | Fed. Rep. of Germany . |
| 8014521 | 8/1980 | Fed. Rep. of Germany . |
| 8210702 | 7/1982 | Fed. Rep. of Germany . |
| 3248862 | 4/1984 | Fed. Rep. of Germany . |
| 3426297 | 1/1986 | Fed. Rep. of Germany . |
| 1242088 | 8/1971 | United Kingdom . |
| 2179622 | 3/1987 | United Kingdom . |

*Primary Examiner*—Bryon P. Gehman

*Attorney, Agent, or Firm*—Robert W. Becker & Associates

[57] ABSTRACT

A packaging for the display and handling of a small object or objects. The packaging includes a support part and a transparent receiving part that is adapted to be held in a pocket of the support part. The receiving part includes a back wall and a front wall that is provided with a bulge for receiving the small object or objects. At that end of the receiving part that is received in the pocket of the support part, the back wall does not extend as far as does the front wall, thus forming an opening that communicates with the bulge of the front wall for the removal or insertion of objects. A repeatedly detachable connection serves to connect the upper sections of the receiving part and of the support part in such a way as to prevent longitudinal displacement of the receiving part and support part relative to one another.

10 Claims, 3 Drawing Sheets

3
1
25
2a
27
h
e
5
8
9
4
7
6
4c
4a
2
10
4b
4d
11
a 3
1
2b
2a
27
h
e
b
7
4
10
11 a1
18
18a
28
17a
16
15 BACK WALL
17
2
19
19a
e1
LOWER EDGE
20
Z
12
24
FLAP PORTION
22
22a
l
16c
p
21
23
23a b1
28
e1
16
15 BACK WALL
23
12
Z
S
22
22'
FLAP PORTION
23a
g
16c
21
22"

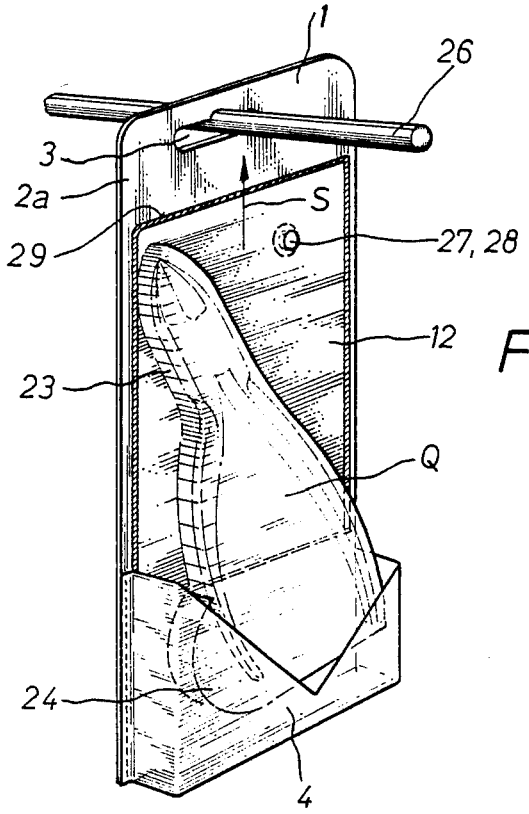
Fig.6
Fig.7
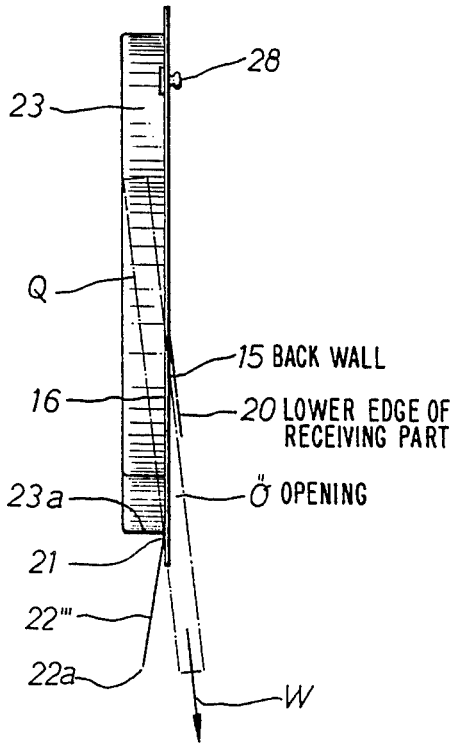
Fig.5
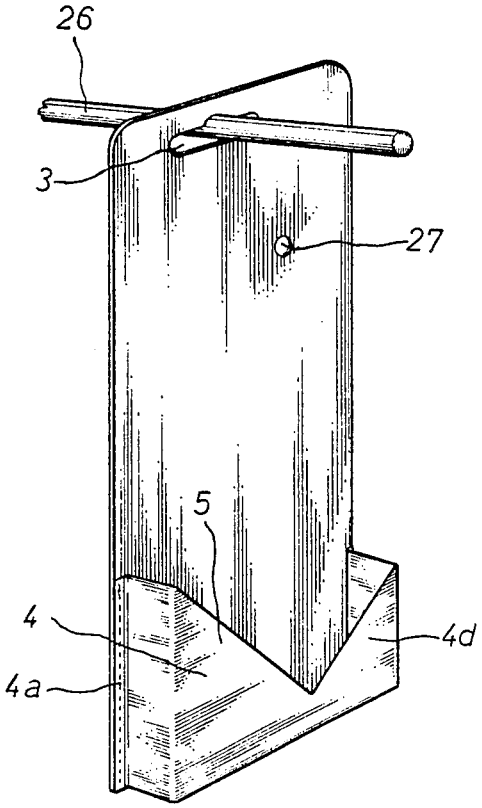

PACKAGING FOR THE DISPLAY AND HANDLING OF SMALL OBJECTS

BACKGROUND OF THE INVENTION

The present invention relates to packaging for the sale or display and handling of small objects, and comprises a support part and a transparent receiving part that is held by the former. The term small object in the sense of the present invention refers to cutlery, such as single shears, scissors, files, and clippers, as well as to small tools, small component part, accessories and spare parts, and also a plurality of screws and nails.

The prior art of such packagings covers a first group in which the receiving part of transparent material for small objects is shiftably guided on the support, which is made of cardboard or flexible material. The protrusion or bulge of the receiving part accommodates the objects and is open towards the support part (German publications 76 04 888, 80 14 231, 77 29 867, 79 20 462). A second group of publications of packagings provides for a detachable connection of the transparent receiving part with the support, e.g. by a press-fastener connection (German publications 82 10 702 and 34 26 297, and PCT-WO 83/00133). The receiving part, as a sealed container, can have a front and a back wall (German publication 34 26 297).

A downwardly open receiving pocket connected with the support part is covered by a third group (GB 2 179 622, GB 1 242 088), with the small object being held against the pocket opening by clamps. A fourth group is covered by U.S. Pat. No. 3,480,138. This known packaging is provided with a cardboard support with a hole for the suspension of the packaging, a transparent pocket that is open upwardly and is rigidly connected on three sides to the support, and with a transparent receiving part, for the small objects, that can be inserted into the pocket. This receiving part is open toward the support and is supposed to be held in position by an upwardly tiltable section of the support.

In contrast to this prior art, it is an object of the present invention to provide a packaging that, in addition to permitting a good view of the small object, also permits a repeated removal of the receiving part from the support part as well as a repeated taking-out of the small object from the packaging, whereby the small object can remain and be examined in the receiving part until its final removal.

The packaging should also prevent the entry of dust and dirt. Furthermore, the receiving part, which is connected with the support part, should be safely secured at its upper and its lower ends against sliding in its longitudinal direction. The removal of the small objects from the opening of the receiving part, especially in view of the nature and quantity of the small objects (e.g. pointed, sharp single objects; a multitude of nails, screws, etc.), should occur in a simple and safe manner.

BRIEF DESCRIPTION OF THE DRAWINGS

These and other objects and advantages of the present invention will appear more clearly from the following specification in conjunction with the accompanying schematic drawings, in which:

FIG. 5 is a view that shows arrangement of the support part on a rod, e.g. of a display stand;

FIG. 6 is a view that show support part and the receiving part with a small object, in this case nail clippers;

FIG. 7 is a view that illustrates the removal of an object from the receiving part;

SUMMARY OF THE INVENTION

Figure 1:
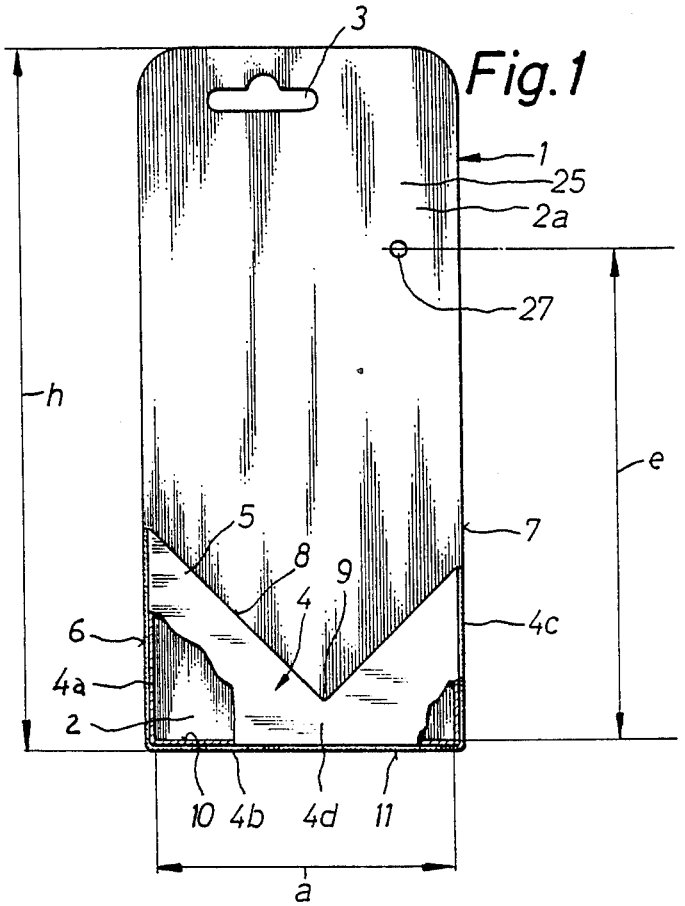
FIG. 1 is a front view of the support part, with its pocket, of one exemplary embodiment of the packaging of the present invention.

The packaging of the present invention is characterized primarily in that the receiving part comprises a front wall and a back wall, that a protrusion or bulge for accommodating the small objects is provided only in the front wall, that the lower section of the receiving part has a removal opening between the two walls of the receiving part and projects into a receiving pocket of the support part, and that the upper section of the receiving part and of the support part are connected to one another, and are secured against relative longitudinal displacement by a repeatedly detachable connection.

The advantage of the packaging of the present invention is revealed by the fact that the receiving part can easily be detached from the support part by releasing the press-fastener connection between the two parts, that the small object, with the receiving part, can be taken out from the pocket of the supporting part, and that in this condition of the parts of the packaging the small object can remain and be viewed in the sealed bulge of the receiving part until it is removed from the bulge of the receiving part.

Further features of the present invention will be described in detail subsequently.

DESCRIPTION OF PREFERRED EMBODIMENTS

Referring now to the drawings in detail, in the illustrated embodiment, the support part 1 is formed of a thin, elongated piece of, for example, synthetic material, which is preferably flexible and has the front side 2*a* and the back side 2*b*. A suspension or hanging opening 3 is provided in the upper section of the supporting part 1 and allows the support part 1 to be suspended in a known manner, for example on a rod 26 of a display stand (FIGS. 5 and 6).

Figure 2:
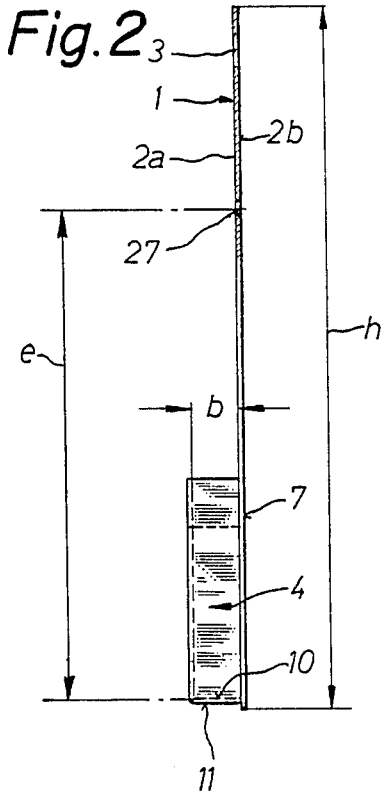
FIG. 2 is a side view of the support part of FIG. 1.

The lower section of the front side 2*a* of the support part 1 is provided with a receiving pocket 4 that is closed off at least laterally, and preferably, as shown, is closed off on two sides and on the bottom. The section 5 of the receiving pocket 4 extends to about one-third of the height or length of the support part 1. The pocket 4 extends approximately from the edge 6 to the opposite edge 7 of the support part 1, whereby the upper edge 8 of the pocket 4 can form a V-shaped notch 9. The length "a" of the pocket 4 is of special importance, as is the thickness "b" of the pocket (FIG. 2). The lower edge 10 of the pocket 4 ends at, or in the vicinity of, the lower edge 11 of the support part 1, so that the pocket 4 intersects or is flush with, or approximately flush with, the edges 6, 7, and 11 of the support part 1. The connection of the pocket edges 4*a*, 4*b*, 4*c* with the support part 1 can be made in a known manner.

Figure 3:
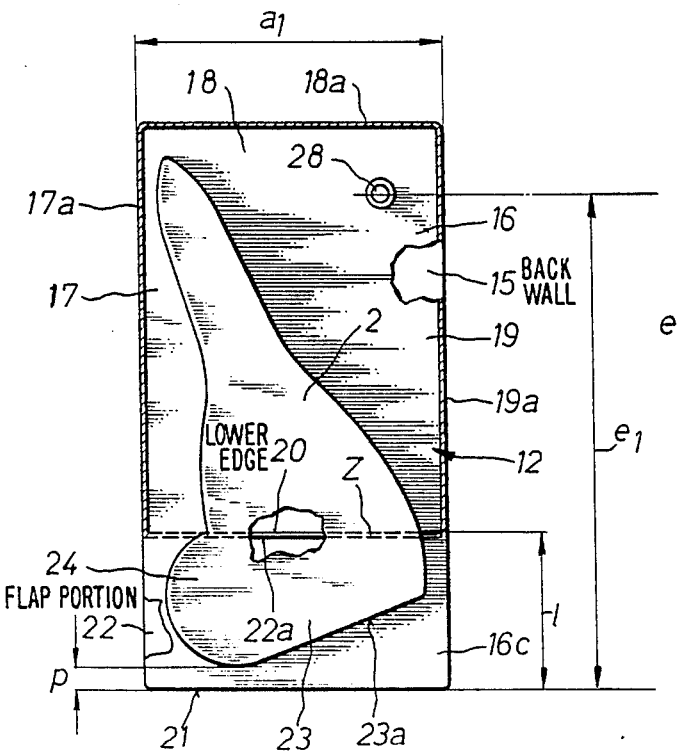
FIG. 3 is a front view of the receiving part, with its bulge, which forms the receiving space, of one exemplary embodiment of the packaging of the present invention.
Figure 4:
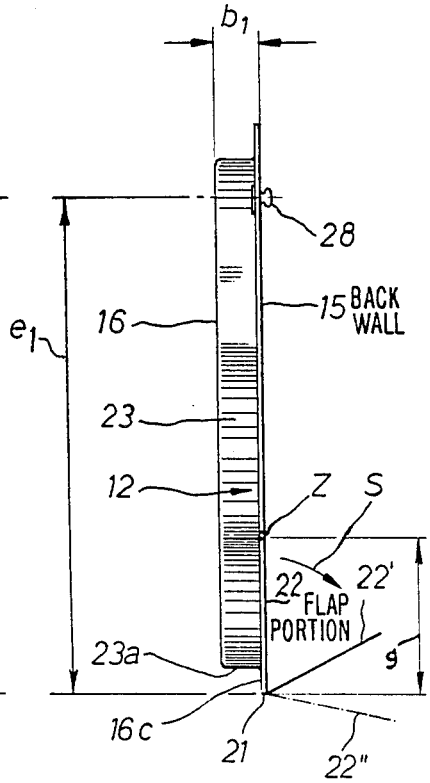
FIG. 4 is a view of the receiving part of FIG. 3.

The receiving part 12 shown in FIGS. 3 and 4 is comprised preferably entirely or partially of thin, stiffened or inherently rigid, transparent material such as plastic, and has a back wall 15 as well as a front wall 16. The walls 15, 16 are connected with one another, e.g. by welding or heat-sealing, on the sides of the regions 17, 18, 19, at 17*a*, 18*a*, 19*a*. The lower edge 20 of the back wall 15 ends at a distance "1" from the lower edge 21 of the front wall 16, where the front wall is folded backwards by 360°, so that the section resulting there forms a flap 22, which is foldable about the lower edge 21 of the front wall 16 in the direction of the arrow S in FIG. 4 into the positions 22′ and 22″ and further (position 22‴ in FIG. 7) for purposes that will be discussed in detail subsequently. The height "g" of the flap 22 is slightly less than the distance "1", so that the lower edge 20 of the back wall 15 leaves an extremely small gap "z" to the parallel upper edge 22*a* of the flap 22. As illustrated in FIG. 3, the section 16*c* of the front wall 16 and the flap 22 are of the same width, and naturally are not connected at their side edges.

The receiving part 12 forms a protrusion or bulge 23, which can be matched in its contour to the small object that is to be accommodated, as is the case also in other known packagings. If the bulge 23 should also accommodate other objects, such as screws, nails, rivets, etc., the bulge can be correspondingly shaped. The bulge 23 has a thickness $b_1$ (FIG. 4), which approximately corresponds to the thickness "b" of the receiving pocket 4 of the support part 1 in such a manner that the bulge 23 of the receiving part 12 can be accommodated in the pocket 4. The width $a_1$ of the receiving part 12 corresponds approximately to the width "a" of the pocket 4 of the support part 1 in such a manner that it guarantees the mentioned possibility of inserting the receiving part 12 into the pocket 4.

The inside width of the bulge 23 is slightly greater than the thickness of the object Q accommodated in the bulge 23 (FIGS. 6 and 7), so that this object is slanted for its removal from the bulge when the flap 22 is pivoted or folded relative to the back wall 15 of the receiving part 12 into the position 22‴; the object Q can be removed in this position from the bulge 23 and thus from the receiving part 12. The bulge 23 ends at a distance "p" from the lower edge 21 of the front wall 16, where the flap 22 starts.

For easy removal of a small object, e.g. a nail clipper, scissors, or a small machine component, from the bulge 23, the latter is provided with an extension or widened portion 24 into which the tip of a thumb or a finger can be introduced in order to bring the object Q in the slanted position shown in FIG. 7 and to remove it from the bulge 23.

In its upper region 25, the support part 1 has a hole 27 that is disposed at a distance "e" from the lower edge 10 of the pocket 4. The receiving part 12, at the same distance $e_1$ from its lower edge 21, has the male part 28 of a press-fastener connection; this male part 28 extends through the front wall 16 and the back wall 15 of the receiving part 12, and protrudes with its head from the back wall; the female part of the connection is represented by the hole 27 of the support part 1. In this way, a repeatedly releasable connection between the receiving part 12 and the support part 1 is formed, i.e., a connection that can be used again and again without being destroyed. The arrangement of the parts of the releasable connection can also be reversed, and it is also possible to choose another repeatedly releasable connection between the parts 1 and 12.

In FIG. 6, the receiving part 12 is connected to the support part 1, with the horizontal rod 26 of a display stand being guided through the opening 3 of the support part. The length or height of the receiving part 12 is selected in such a manner that the upper edge 29 of the receiving part 12 ends below the opening 3, so that the receiving part 12 can be removed from the support part 1, independently of the support part 1 suspended on the rod 26, after the press-fastener connection 27, 28 has been released.

Figure 8:
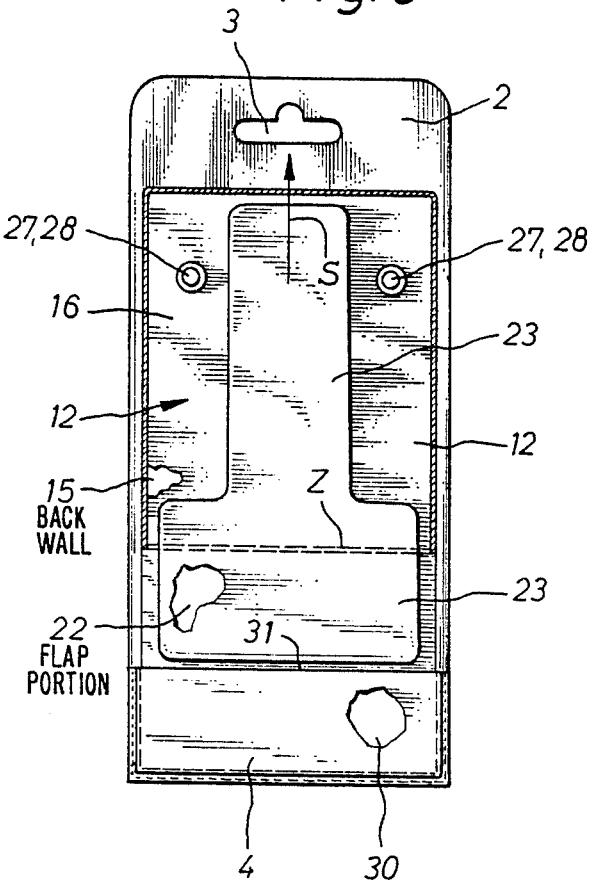
FIG. 8 is a plan view of a further embodiment of the packaging of the present invention.
Figure 9:
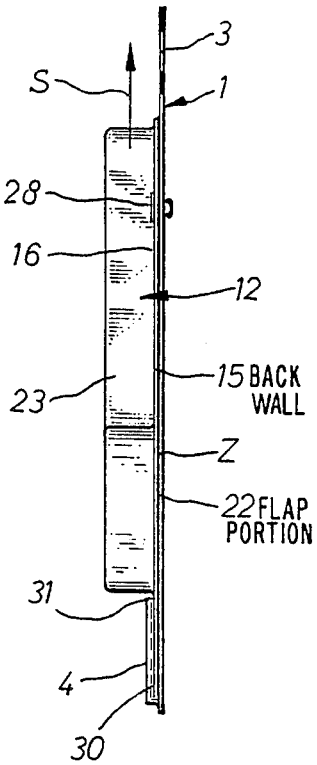
FIG. 9 is a side view of the packaging of FIG. 8.

In the embodiment illustrated in FIGS. 8 and 9, the support part 1 has a pocket 4, the thickness of which is less than the thickness of the bulge 23 of the receiving part 12. This thickness of the pocket 4 corresponds to the thickness of the end section 30 of the receiving part 12, with the protrusion 23 having a length or height that extends approximately from above the edge 31 of the pocket 4 to below the suspension opening 3 of the support part 1. One or two press-fastener connections 27, 28 are provided in the same manner as in the embodiment of FIGS. 1 to 7.

If a packaging that is provided with one or more objects Q is in a vertical position, and if the receiving part 12 has been removed upwards from the pocket 4 after the release of the press-fastener connection 27, 28, the flap 22, in its closed or approximately closed position, prevents the object or objects from falling out of the bulge 23. If the flap 22 is brought into the position 22‴ (FIG. 7), the object Q (or the objects) can be removed from the receiving part, through the opening Ö between the lower edge 20 of the back wall 15 and the lower end 23*a* of the bulge 23, in the direction of the arrow W in FIG. 7. The same object (or the same objects) or other objects can be introduced in the same manner into the bulge 23, after which the flap 22 is closed and the receiving part is slipped into the pocket 4.

In addition to preventing objects from falling out of the bulge 23, in its closed position the flap 22 can also serve another purpose. In particular, it is possible to place the bottom portion of a card, instruction booklet, or other similar material into the region between the flap 22 and the back side of the front wall 16 of the receiving part 12. The top portion of the card, booklet, etc. will then be disposed between the back wall 15 of the receiving part 12 and the front side 2*a* of the support part 1 when the receiving part 12 is inserted into the pocket 4 of the support part 1.

Figure 10:
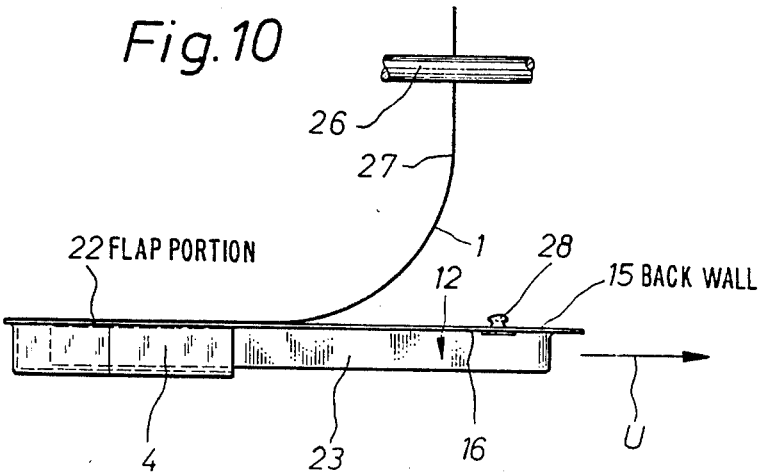
FIG. 10 is a view that illustrates the removal of the receiving part from the support part when the latter hangs on a rod.

As illustrated in FIG. 10 it is also possible, however, to bend the flexible support part 1, when it hangs on a rod, or else to hold it approximately horizontally, so that the pocket 4 and the receiving part 12 will be in a horizontal position, so that the bulge 23 will be pointed downwardly. In this case, the receiving part 12 can be pulled out like a drawer from the pocket 4, in the direction of the arrow U, after having previously released the press-fastener connection 27, 28. When the flap 22 is swung up, the object or objects can be removed upwardly from the bulge 23. This type of usage of the packaging is particularly appropriate for several objects, e.g. screws, nails, rivets, etc. When inserting the receiving part 12 into the pocket 4, it is necessary only to swivel the flap 22 into the position 22″ or 22′, i.e. behind the plane of the two walls 15, 16, since upon insertion of the receiving part 12 into the pocket 4 the flap 22 slides into its closed position along the support part 1.

As shown by the comparison of FIGS. 1 and 3, the design of the front wall 4*d* of the pocket 4 ensures that the widened portion 24 of the bulge 23 is covered by a front wall region, in FIG. 1, the region 5.

If the receiving part 12 is connected in the preferred manner to the support part 1 only by means of a single press-fastener connection 27, 28, the accurate mutual positioning of the parts 1 and 12 is ensured by the pocket 4, the size of which corresponds to the lower end of the receiving part 12.

Since the receiving part 12 comprises thin-walled synthetic material, the receiving part can be slightly deformed elastically, if necessary, on removal of the object Q from the bulge 23 of the receiving part 12.

The above shows that the bulge 23 is closed off along its upper side and virtually over the main part of its length, thus preventing the entry of dust and the like. It is further evident that the receiving pocket 4 extends over about one-third of the height "h" of the support part 1; however, it need not extend this far.

The press-fastener connection 27, 28 that is used reliably prevents a relative displacement of the parts 1 and 12, i.e. a mutual relative motion of the parts in the direction of the arrow S (FIGS. 6, 8 and 9), even when the support part 1 is removed from the rod 26, e.g. during handling or transport.

The present invention is, of course, in no way restricted to the specific disclosure of the specification and drawings, but also encompasses any modifications within the scope of the appended claims.

What we claim is:

1. Packaging for the display and handling of a small object or objects, comprising:

a support part having a first end portion, and a second end portion at which is disposed a pocket that is open toward said first end portion of said support part and is connected on three sides to said support part;

a transparent receiving part that is held in said pocket of said support party; said receiving part includes a front wall, and a back wall that is disposed against said support part when said receiving part is held in said pocket of said support part; said front wall of said receiving part is provided with a bulge for receiving said small object or objects; said receiving part has a first end portion, and a second end portion that is remote from said first end portion thereof and is received in said pocket of said support part; at said second end portion of said receiving part, said back wall does not extend as far from said first end portion thereof as does said front wall, thus forming an opening that communicates with said bulge for removal or insertion of objects; and repeatedly detachable connection means for connecting said first end portion of said receiving part to said first end portion of said support part so as to prevent entry of dust and dirt as well as to prevent longitudinal displacement of said receiving part and said support part relative to one another so that the packaging, in addition to permitting a good view of the small object or objects, also permits a repeated removal of said receiving part from said support part as well as a repeated taking-out of the small object from the packaging, whereby the small object can remain and be examined in the receiving part until final removal thereof.

2. Packaging for the display and handling of a small object or objects, comprising:

a support part having a first end portion, and a second end portion at which is disposed a pocket that is open toward said first end portion of said support part and is connected on three sides to said support part;

a transparent receiving part that is held in said pocket of said support part; said receiving part includes a front wall, and a back wall that is disposed against said support part when said receiving part is held in said pocket of said support part; said front wall of said receiving part is provided with a bulge for receiving said small object or objects; said receiving part has a first end portion, and a second end portion that is remote from said first end portion thereof and is received in said pocket of said support part; at said second end portion of said receiving part, said back wall does not extend as far from said first end portion thereof as does said front wall, thus forming an opening that communicates with said bulge for removal or insertion of objects;

repeatedly detachable connection means for connecting said first end portion of said receiving part to said first end portion of said support part so as to prevent entry of dust and dirt as well as to prevent longitudinal displacement of said receiving part and said support part relative to one another; and edges of said front wall and said back wall of said receiving part being connected to one another over a portion of their length; said back wall being provided with a lower edge remote from said first end portion of said receiving part; said bulge being provided with a lower edge remote from said first end portion of said receiving part; said opening being disposed at least in part between said lower edge of said back wall and said lower edge of said bulge; said front wall having a lower edge remote from said first end portion of said receiving part; said front wall having a flap portion that is connected to said front wall at said lower edge thereof and is pivotable about this lower edge to such an extent that it can selectively cover and uncover said opening.

3. Packaging according to claim 2, in which said pocket extends at most over one third of the distance between said first and second end portions of said support part.

4. Packaging according to claim 3, in which said pocket has a thickness that corresponds approximately to the thickness of said bulge of said receiving part.

5. Packaging according to claim 3, in which said pocket has a thickness that corresponds approximately to the sum of the thicknesses of said support part, and of said front and back walls of said receiving part.

6. Packaging according to claim 2, in which said connection means for detachably connecting said receiving part and said support part is in the form of a press-fastener connection that includes a female part in the form of a hole in said first end portion of said support part, and a male part that extends through said front and rear walls of said receiving part and is received in said hole of said support part.

7. Packaging according to claim 6, in which said hole of said support part is spaced from a lower pocket edge, which is remote from said first end portion of said support part, by a distance that corresponds approximately to the distance of said male part of said press-fastener connection in said receiving part from said lower edge of said front wall of said receiving part.

8. Packaging according to claim 2, in which said bulge of said receiving part has a laterally extending widened portion for access by the tip of a person's thumb or finger.

9. Packaging according to claim 2, in which said bulge of said receiving part has a thickness that is slightly greater than the thickness of an object that is to be accommodated in said bulge.

10. Packaging according to claim 2, in which said flap portion, when it is pivoted about said lower edge of said front wall to cover said opening, extends from said lower edge of said front wall toward said first end portion of said receiving part by a distance that is slightly less than the distance of said lower edge of said back wall from said lower edge of said front wall.

* * * * *